US010119538B2

(12) United States Patent
Kaneko et al.

(10) Patent No.: US 10,119,538 B2
(45) Date of Patent: Nov. 6, 2018

(54) RECIPROCATING PUMP

(71) Applicant: MARUYAMA MFG. CO., INC., Tokyo (JP)

(72) Inventors: Takayuki Kaneko, Tokyo (JP); Nobuhiro Yuhashi, Tokyo (JP)

(73) Assignee: MARUYAMA MFG. CO., INC., Tokyo (JP)

( * ) Notice: Subject to any disclaimer, the term of this patent is extended or adjusted under 35 U.S.C. 154(b) by 95 days.

(21) Appl. No.: 15/248,728

(22) Filed: Aug. 26, 2016

(65) Prior Publication Data

US 2017/0058890 A1 Mar. 2, 2017

(30) Foreign Application Priority Data

Aug. 26, 2015 (JP) ..... 2015-166571

(51) Int. Cl.

| | |
|---|---|
| ***F04B 53/18*** | (2006.01) |
| ***F04B 1/00*** | (2006.01) |
| ***F04B 9/02*** | (2006.01) |
| ***F04B 53/08*** | (2006.01) |
| ***F04B 1/04*** | (2006.01) |
| ***F04B 53/16*** | (2006.01) |

(52) U.S. Cl.

CPC ..... *F04B 53/18* (2013.01); *F04B 1/00* (2013.01); *F04B 1/0404* (2013.01); *F04B 9/02* (2013.01); *F04B 53/08* (2013.01); *F04B 53/16* (2013.01)

(58) Field of Classification Search

CPC ..... F04B 53/18; F04B 1/00; F04B 1/0404; F04B 9/02; F04B 53/08; F04B 53/16

See application file for complete search history.

(56) References Cited

U.S. PATENT DOCUMENTS 1,960,927 A * 5/1934 Siegert ..... F16J 15/186 184/26
2,239,853 A * 4/1941 Lource ..... F04B 1/00 184/11.1
3,529,698 A * 9/1970 Nelson ..... B61C 17/08 184/11.2
4,270,497 A * 6/1981 Valerio ..... F01M 11/0004 123/195 C
4,519,348 A * 5/1985 Hamilton ..... F01M 11/0004 123/195 C
4,553,298 A * 11/1985 Grable ..... F04B 9/02 227/152

(Continued)

FOREIGN PATENT DOCUMENTS

| | | |
|---|---|---|
| JP | S60139091 U | 9/1985 |
| JP | 2003148359 A | 5/2003 |
| JP | 2010-053834 A | 3/2010 |

OTHER PUBLICATIONS

Japanese Office Action dated Mar. 20, 2018 for Application No. P2015-166571.

*Primary Examiner* — Michael A Riegelman
(74) *Attorney, Agent, or Firm* — Moser Taboada

(57) ABSTRACT

In a reciprocating pump which performs a pumping action by causing a reciprocating member to reciprocate as a driving part including a driving shaft accommodated in a driving part case is driven, a portion of the driving part is immersed in a lubricating oil in the driving part case, and one or more ribs are provided on an upper part of an inner wall forming the driving part case so as to be directed inward.

11 Claims, 2 Drawing Sheets

(56) References Cited

U.S. PATENT DOCUMENTS

| | | | | | |
|---|---|---|---|---|---|
| 4,721,184 | A * | 1/1988 | Sowards | F16H 57/0447 | 184/11.1 |
| 5,072,784 | A * | 12/1991 | Stenlund | F16H 57/0415 | 165/164 |
| 5,507,219 | A * | 4/1996 | Stogner | F04B 53/147 | 403/2 |
| 7,219,594 | B2 * | 5/2007 | Kugelev | F04B 53/08 | 92/144 |
| 7,341,039 | B1 * | 3/2008 | Jaszewski | F01M 11/0004 | 123/195 AC |
| 8,746,405 | B2 * | 6/2014 | Perakes | F16H 57/0409 | 184/6.12 |
| 8,899,381 | B2 * | 12/2014 | Ebihara | B60K 7/0007 | 184/6.12 |
| 9,670,923 | B2 * | 6/2017 | Weaver | F04B 53/143 | |
| 9,702,359 | B2 * | 7/2017 | Kerr | F04B 53/16 | |
| 9,772,027 | B2 * | 9/2017 | Preston | F16H 57/0423 | |
| 9,856,971 | B2 * | 1/2018 | Mikami | F16H 57/0424 | |
| 2005/0103570 | A1 * | 5/2005 | Gibson | F16H 57/0421 | 184/6.12 |
| 2010/0260631 | A1 * | 10/2010 | Kugelev | F04B 53/144 | 417/437 |
| 2010/0322802 | A1 * | 12/2010 | Kugelev | F04B 53/147 | 417/437 |
| 2011/0239856 | A1 * | 10/2011 | Tiller | F04B 53/18 | 92/153 |

* cited by examiner

RECIPROCATING PUMP

CROSS-REFERENCE TO RELATED APPLICATIONS

The disclosure is based upon and claims the benefit of priority from Japanese Patent Application No. 2015-166571, filed on Aug. 26, 2015, the entire contents of which are incorporated herein by reference.

TECHNICAL FIELD

This disclosure relates to a reciprocating pump.

BACKGROUND

In the related art, as a reciprocating pump, a reciprocating pump in which a driving part including a crankshaft, a conrod, and the like is accommodated a crankcase and a cylinder portion is provided in a manifold connected to the crankcase is known (for example, refer to Japanese Unexamined Patent Publication No, 2010-53834). The reciprocating pump performs a pumping action of, by causing a reciprocating member to reciprocate in the cylinder portion as the crankshaft rotates, suctioning an operating liquid into a pump chamber formed on the tip end side in the cylinder portion, pressurizing the operating liquid, and discharging the operating liquid toward the outside.

In the reciprocating pump described above, in general, about half the inside of the crankcase is filled with an lubricating oil. Heat of the lubricating oil in the crankcase is dissipated toward the outside air from the surface of the crankcase and is absorbed by a manifold due to the operating liquid flowing through the manifold such that an equilibrium state is achieved. The lubricating oil in the crankcase obtains fluidity as being stirred by the rotation of the crankshaft and moves around sliding portions (metal contact portions) such as the crankshaft or the conrod such that the sliding portions are lubricated and cooled by the lubricating oil.

SUMMARY

Here, the lubricating oil in the crankcase is scooped up due to the rotation of the crankshaft, and a portion of the lubricating oil that is scooped up reaches and adheres to the upper part of the inner wall (upper wall) of the crankcase due to the centrifugal force. When the lubricating oil adheres to the inner wall as described above, the amount of the lubricating oil which contributes to lubrication and cooling decreases and the sliding portions are not sufficiently lubricated and cooled. As a result, the temperature of the lubricating oil (hereinafter, called oil temperature) in the crankcase increases, and thus there is a demand for a reduction in the oil temperature.

This disclosure describes a reciprocating pump capable of reducing an oil temperature in a driving part case including a crankcase.

According to an aspect of this disclosure, there is provided a reciprocating pump which performs a pumping action by causing a reciprocating member to reciprocate as a driving part including a driving shaft accommodated in a driving part case is driven, a portion of the driving part being immersed in a lubricating oil in the driving part case, the reciprocating pump including: one or more ribs which are provided on an upper part of an inner wall forming the driving part case so as to be directed inward.

In the reciprocating pump described above, the lubricating oil, which is scooped up during driving of the driving part and adheres to the upper part of the inner wall of the driving part case, drops downward along the ribs provided on the upper part of the inner wall to be directed inward and returns to the sliding portion side included in the driving part. Therefore, the lubricating oil is efficiently supplied to a sliding portion side, the sliding portion can be sufficiently lubricated and cooled, and the oil temperature can be reduced. In addition, since the heat transfer area of the driving part case is increased by the ribs, the heat dissipation efficiency of the driving part case can be increased, and the oil temperature can be further reduced.

In some of aspects, some of the ribs are disposed right above the driving shaft. The lubricating oil adhered to the upper part of the inner wall of the driving part case drops toward the driving shaft positioned right therebelow along the rib positioned right above the driving shaft. Therefore, the driving shaft that forms the sliding portion can be reliably and sufficiently lubricated and cooled, and thus the oil temperature can be further reduced.

As described above, since the oil temperature in the driving part case can be reduced, compared to the related art, the amount of the lubricating oil in the driving part case can be reduced. Specifically, a configuration in which the sectional shape of the inner wall of the driving part case perpendicular to the axis of the driving shaft, which reduces the amount of the lubricating oil, is an elliptical shape may be employed. When the elliptical shape is employed, for example, with a simple configuration in which the radius of the major axis of the elliptical shape is the same as the radius of the circular sectional shape of a driving part case in the related art, the amount of the lubricating oil in the driving part case can be further reduced compared to the related art. That is, by causing the sectional shape of the inner wall of the driving part case to be the elliptical shape, the amount of the lubricating oil can be reduced.

According to this disclosure described above, the reciprocating pump capable of reducing the oil temperature in the driving part case can be provided.

DETAILED DESCRIPTION

Figure 1:
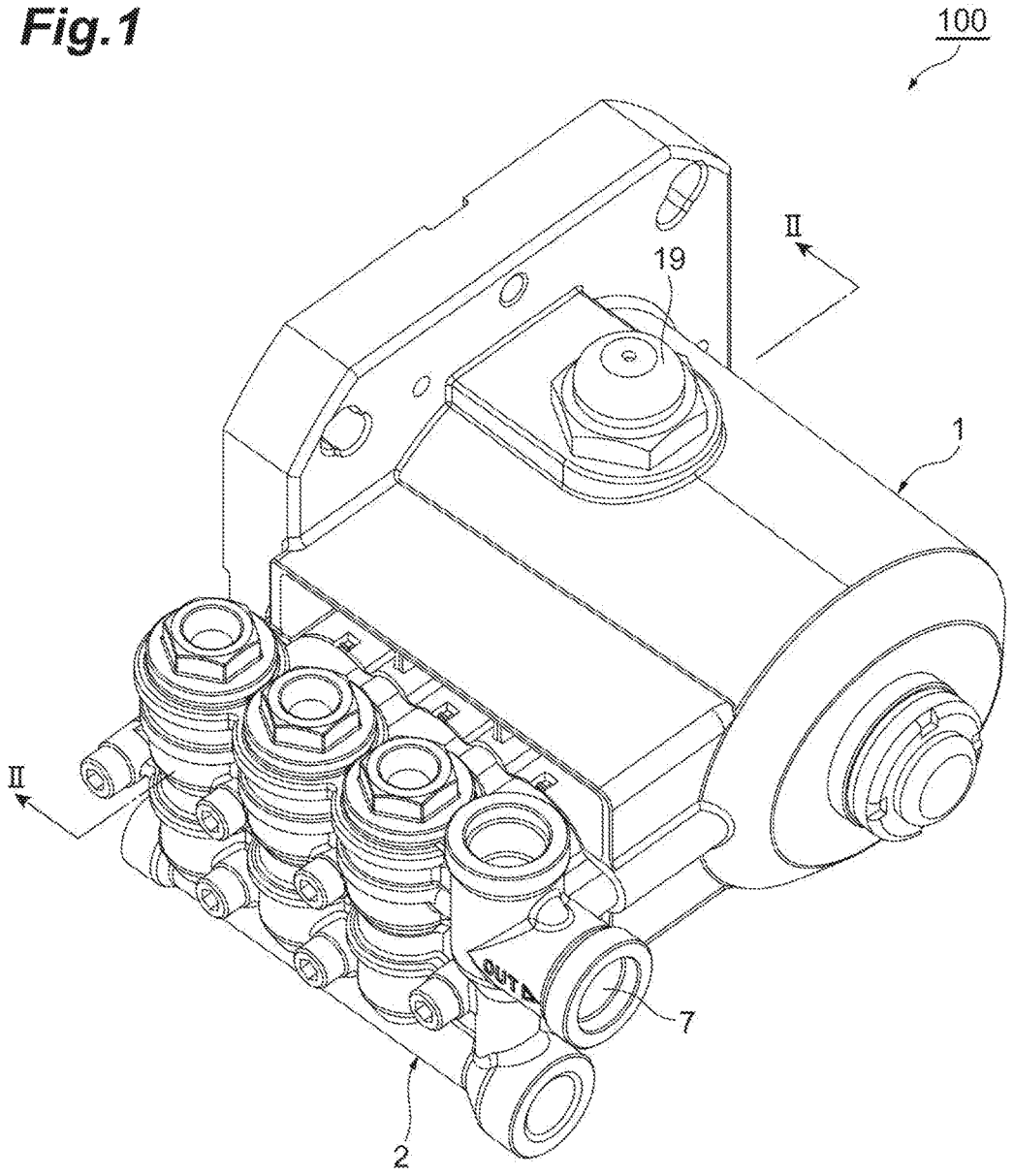
FIG. 1 is a perspective view illustrating the external appearance of a reciprocating pump according to an embodiment of this disclosure.
Figure 2:
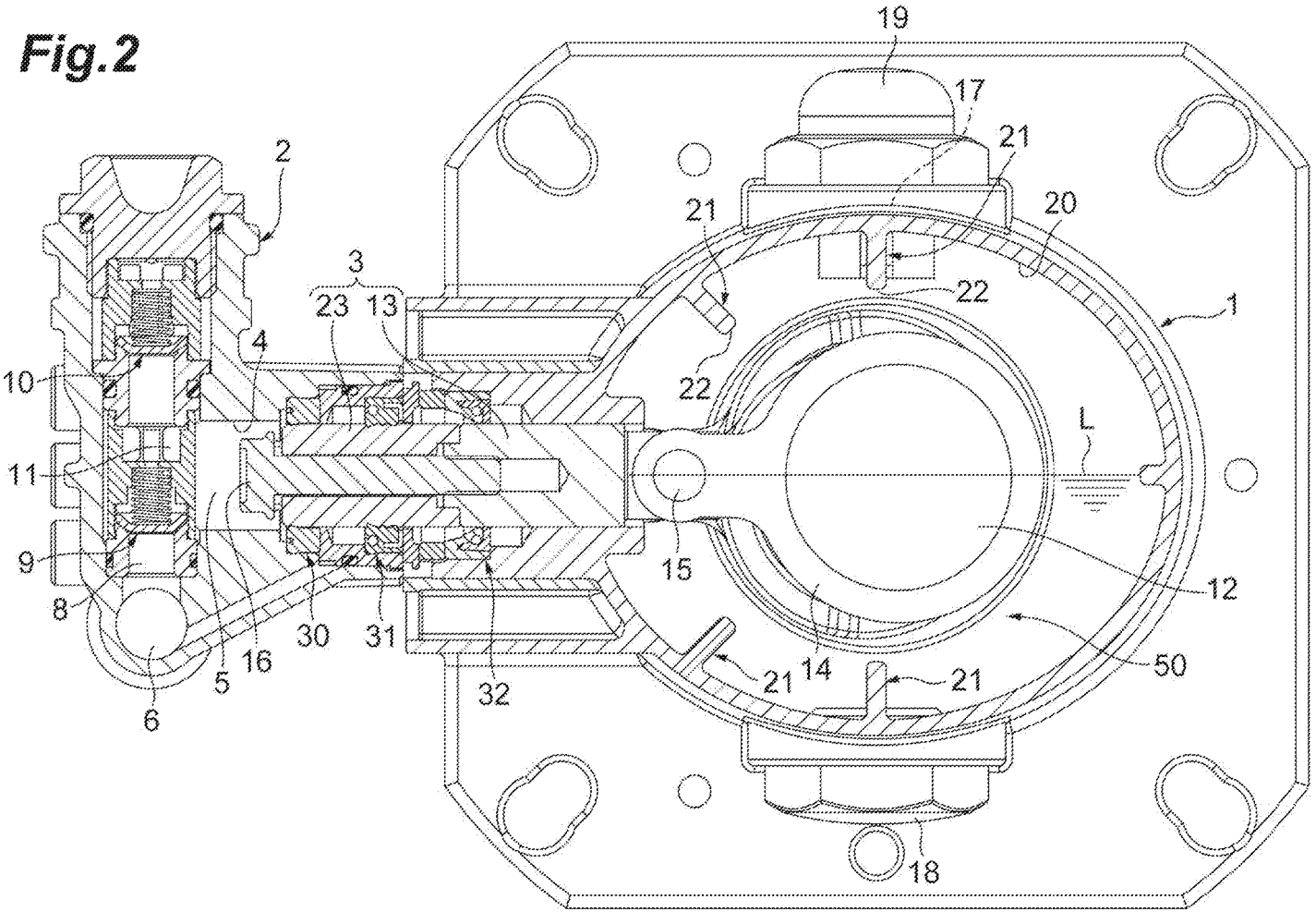
FIG. 2 is a view taken along arrow II-II and is a sectional view taken along the axis of a reciprocating member.

Hereinafter, an embodiment of a reciprocating pump according to this disclosure will be described with reference to the accompanying drawings. FIG. 1 is a perspective view illustrating the external appearance of the reciprocating pump according to the embodiment of this disclosure, and FIG. 2 is a view taken along arrow II-II and is a sectional view taken along the axis of a reciprocating member. Here, the reciprocating pump is a plunger pump, and is a so-called horizontal triplex plunger pump in which plungers included in reciprocating members are provided in three parallel rows in a horizontal direction.

As illustrated in FIG. 1, the external form of a plunger pump 100 is formed by a crankcase (driving part case) 1 and a manifold 2 connected to the crankcase 1.

In the manifold 2, as illustrated in FIG. 2, a cylinder portion 4 in which a plunger sleeve 23 included in a reciprocating member 3 reciprocates is formed and a pump chamber 5 is formed on the tip end side of the cylinder portion 4. In the manifold 2, a suction port 6 through which an operating liquid is introduced into the pump chamber 5, and a discharge port (see FIG. 1) through which the operating liquid compressed in the pump chamber 5 is discharged are provided. The suction port 6 and the discharge port 7 are connected by a flow passage 8. A suction valve 9 is provided on the suction port 6 side of the flow passage 8 A discharge valve 10 is provided on the discharge port 7 side of the flow passage 8. A portion 11 in the flow passage 8 between the suction valve 9 and the discharge valve 10 is connected to the pump chamber 5.

In order to prevent leakage of the operating liquid in the pump chamber 5 toward the crankcase 1, in the manifold 2, a high pressure seal 30 and a low pressure seal 31 which slidably and liquid-tightly come into contact with the reciprocating member 3 (plunger sleeve 23) are disposed in this order from the pump chamber 5 side.

The crankcase 1 is formed to be hollow. Inside the crankcase 1, a crankshaft (driving shaft) 12, a conrod which is rotatably connected to the crankshaft 12, a piston pin 15 which rotatably connect a plunger 13 included in the reciprocating member 3 to the conrod 14, and the like are disposed and constitute a driving part 50 for driving the reciprocating member 3. Regarding the crankcase 1 which accommodates the driving part 50 therein, the sectional shape thereof perpendicular to the axis of the crankshaft 12 is an elliptical shape formed into a predetermined thickness. That is, the inner and outer walls thereof have the elliptical shape, which is an elliptical shape in which the major axis is positioned in the horizontal direction.

The plunger 13 and the plunger sleeve 23 disposed closer to the pump chamber 5 side than the plunger 13 are connected by a bolt 16 and constitute the reciprocating member 3. In an internal section from the crankcase 1 to the manifold 2, the plunger 13 is disposed on the crankcase 1 side, and the plunger sleeve 23 is disposed in the cylinder portion 4 on the manifold 2 side. A rotating portion between the crankshaft 12 and the conrod 14, a rotating portion between the conrod 14 and the piston pin 15, and the like become sliding portions in the crankcase 1.

The inside of the crankcase 1 is filled with a lubricating oil (oil) L through an oil filler hole 17 on the upper side. As necessary, the lubricating oil can be discharged through a drain plug 18 on the lower side. In addition, the oil filler hole 17 is blocked by an oil filler plug 19.

The lubricating oil L fills the inside of the crankcase 1 to the vicinity of the center axis line of the crankshaft 12, that is, fills about half the inside of the crankcase 1, and about the lower half portion of the driving part 50 is immersed in the lubricating oil L.

In addition, on the manifold 2 side of the crankcase 1, in order to prevent leakage of the lubricating oil L from the inside of the crankcase 1, an oil seal 32 which slidably and liquid-tightly come into contact with the reciprocating member 3 (the plunger 13) is disposed.

In this embodiment, on an inner wall 20 formed in the crankcase 1, a plurality of ribs 21 protruding inwardly are formed. The ribs 21 lengthily extend in the axis direction of the crankshaft, and are provided at two points on the upper part of the inner wall 20.

One rib 21 is provided to correspond to the rotating portion (sliding portion) between the crankshaft 12 and the conrod 14 and is disposed substantially right above the crankshaft 12. The other rib 21 is provided to correspond to the rotating portion (sliding portion) between the conrod 14 and the piston pin 15 and is disposed at a position at about 45° from one rib 21 toward the manifold 2 side along the circumferential direction. Tip ends (lower ends) of the ribs 21 are directed toward the crankshaft 12. In addition, the ribs 21 are provided to be symmetrical.

According to the plunger pump 100 having this configuration, when the driving part 50 is driven and the crankshaft 12 is driven to rotate, the reciprocating member 3 connected to the crankshaft 12 via the conrod 14 reciprocates, and the plunger sleeve 23 reciprocates in the cylinder portion 4. As the reciprocating member 3 moves toward the crankshaft 12 side, the pump chamber 5 is depressurized, the suction valve 9 and the discharge valve 10 of the manifold 2 are respectively opened and closed, and the operating liquid is suctioned into the pump chamber 5 through the suction port 6 and the suction valve 9. On the other hand, as the reciprocating member 3 moves toward the side opposite to the crankshaft 12, the pump chamber 5 is pressurized, the suction valve 9 and the discharge valve 10 are respectively closed and opened, and the operating liquid in the pump chamber 5 is discharged to the discharge port 7 through the discharge valve 10. That is, the plunger pump 100 performs a pumping action of suctioning, pressurizing, and discharging the operating liquid.

While the plunger pump 100 as described above is driven, the lubricating oil L in the crankcase 1 is scooped up due to the rotation of the crankshaft 12, and a portion thereof reaches and adhere to the upper part of the inner wall 20 of the crankcase 1 due to the centrifugal force. The lubricating oil L adhered to the upper part of the inner wall 20 drops downward along the ribs 21 and return to the sliding portion side included in the driving part 50.

Specifically, regarding on one rib 21 disposed substantially right above the crankshaft 12, the lubricating oil L drops along the rib 21 from a tip end 22 thereof toward the right lower side, and returns only to the rotating portion between the crankshaft 12 and the conrod 14. That is, the lubricating oil L is efficiently supplied to the sliding portion which is the rotating portion between the crankshaft 12 and the conrod 14.

According to the other rib 21 at a position at about 45° from one rib 21 toward the manifold 2 side along the circumferential direction, the lubricating oil L drops along the rib 21 from a tip end 22 thereof toward the right lower side, and returns only to the rotating portion between the conrod 14 and the piston pin 15. That is, the lubricating oil L is efficiently supplied to the sliding portion which is the rotating portion between the conrod 14 and the piston pin 15.

As described above, in this embodiment, the lubricating oil L which is scooped up during the driving of the driving part 50 and adheres to the upper part of the inner wall 20 of the crankcase 1 drops downward along the ribs 21 provided on the upper part of the inner wall 20 to be directed inward, returns to the sliding portion side included in the driving part 50, and is efficiently supplied to the sliding portion. The sliding portion can be sufficiently lubricated and cooled, and as a result, the oil temperature can be reduced. In addition, since the heat transfer area of the crankcase 1 is increased by the ribs 21, the heat dissipation efficiency of the crankcase 1 can be increased, and as a result, the oil temperature can be further reduced.

In this embodiment, some of the ribs 21 is disposed right above the crankshaft 12, and the lubricating, oil L adhered to the upper part of the inner wall 20 of the crankcase 1 drops toward the crankshaft 12 positioned right therebelow along the rib 21. The crankshaft 12 that forms the sliding portion can be reliably and sufficiently lubricated and cooled, and thus the oil temperature can be further reduced.

As described above, since the oil temperature in the crankcase 1 can be reduced, compared to the related art, the amount of the lubricating oil L in the crankcase 1 can be reduced. Specifically, in the related art, the sectional shape of the inner wall, of a crankcase when viewed in the axis direction of a crankshaft is a circular shape. However, as in this embodiment, by causing the sectional shape of the inner wall 20 of the crankcase 1 to be an elliptical shape, and for example, by causing the radius of the major axis of the elliptical shape to be the same as the radius of the circular shape of the related art, the amount of the lubricating oil L in the crankcase 1 can be further reduced compared to the related art. That is, as in the embodiment, by causing the sectional shape of the inner wall 20 of the crankcase 1 to be the elliptical shape, the amount of the lubricating oil L can be reduced.

While this disclosure has been described in detail on the basis of the embodiment, the present invention is not limited to the embodiment described above. For example, in the embodiment described above, the number of ribs 21 on the upper part of the inner wall 20 of the crankcase 1 is two, but may also be one or three or more. One or more ribs 21 may be configured to cause the lubricating oil L to efficiently drop toward the sliding portions from the ribs 21 and to cause the sliding portions to be sufficiently lubricated and cooled.

In the embodiment described above, the plunger pump 100 is of a multiple type but may also be applied to a simplex (a single plunger) plunger pump.

In the embodiment described above, the application of the plunger pump has been described. However, the present invention can also be applied to, for example, a forced valve type piston pump. The present invention can be applied to any reciprocating pump which performs a pumping action using a reciprocating member that reciprocates as a driving part including a driving shaft accommodated in a driving part case is driven.

What is claimed is:

1. A reciprocating pump which performs a pumping action by causing a reciprocating member to reciprocate as a driving part including a driving shaft accommodated in a driving part case is driven, a portion of the driving part being immersed in a lubricating oil in the driving part case, the driving part case including an inner wall which has an upper part positioned above the lubricating oil, the reciprocating pump comprising:

one or more ribs which are provided on the upper part of the inner wall of the driving part case so as to be directed inward, wherein at least one of the ribs is disposed directly above the driving shaft.

2. The reciprocating pump according to claim 1, wherein a sectional shape of the inner wall of the driving part case perpendicular to an axis of the driving shaft is an elliptical shape.

3. The reciprocating pump according to claim 1, wherein at least one of the ribs is directed inward toward a center axis of the driving shaft.

4. A reciprocating pump comprising:

a reciprocating member configured to reciprocate as a driving part including a driving shaft is driven, to cause a pump action, a driving part case accommodating the driving shaft, the driving part case including an inner wall which has an upper part positioned above a center axis of the driving shaft, first and second ribs which are provided on the upper part of the inner wall of the driving part case so as to be directed inward, the first and second ribs being disposed at different positions in a circumferential direction of the inner wall.

5. The reciprocating pump according to claim 4, wherein the first rib is disposed directly above the driving shaft.

6. The reciprocating pump according to claim 4, wherein the first rib is directed inward toward the center axis of the driving shaft.

7. The reciprocating pump according to claim 4, wherein the second rib is disposed obliquely above the driving shaft.

8. The reciprocating pump according to claim 7, wherein the second rib is directed inward toward the center axis of the driving shaft.

9. A reciprocating pump comprising:

a reciprocating member configured to reciprocate as a driving part including a driving shaft is driven, to cause a pump action, a driving part case accommodating the driving shaft, the driving part case including an inner wall, a plurality of ribs which are disposed at different positions in a circumferential direction of the inner wall, the ribs being provided on the inner wall of the driving part case so as to be directed inward toward a center axis of the driving shaft.

10. The reciprocating pump according to claim 9, wherein at least one of the ribs is disposed directly above the driving shaft.

11. The reciprocating pump according to claim 9, wherein at least one of the ribs is disposed obliquely above the driving shaft.

* * * * *